US009928746B1

(12) United States Patent
MacNeille et al.

(10) Patent No.: US 9,928,746 B1
(45) Date of Patent: Mar. 27, 2018

(54) VEHICLE-TO-VEHICLE COOPERATION TO MARSHAL TRAFFIC

(71) Applicant: Ford Global Technologies, LLC, Dearborn, MI (US)

(72) Inventors: Perry Robinson MacNeille, Dearborn, MI (US); Joseph Wisniewski, Royal Oak, MI (US); Nunzio DeCia, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/268,484

(22) Filed: Sep. 16, 2016

(51) Int. Cl.
*G08G 1/00* (2006.01)
*G08G 1/01* (2006.01)

(52) U.S. Cl.
CPC ..... *G08G 1/22* (2013.01); *G08G 1/0133* (2013.01)

(58) Field of Classification Search
CPC ..... G08G 1/22
USPC ..... 701/96, 117–118, 469, 538, 24
See application file for complete search history.

(56) References Cited

U.S. PATENT DOCUMENTS 7,969,324 B2 6/2011 Chevion et al.
8,179,281 B2 * 5/2012 Strauss ..... G08G 1/163 340/425.5
8,352,112 B2 * 1/2013 Mudalige ..... G08G 1/22 340/435
8,924,240 B2 * 12/2014 Depura ..... H04W 52/0258 701/469
9,147,353 B1 * 9/2015 Slusar ..... G09B 19/167
9,355,423 B1 * 5/2016 Slusar ..... G06Q 40/08
9,390,451 B1 * 7/2016 Slusar ..... G06Q 40/04
9,443,358 B2 * 9/2016 Breed ..... G06F 8/65
9,623,876 B1 * 4/2017 Slusar ..... B60W 40/09
2009/0271084 A1 10/2009 Taguchi
2010/0256836 A1 * 10/2010 Mudalige ..... G08G 1/163 701/2
2012/0004835 A1 1/2012 Sato
2012/0123660 A1 5/2012 Kagawa et al.
2012/0166059 A1 6/2012 Aso
2013/0116909 A1 5/2013 Shida
(Continued)

OTHER PUBLICATIONS

Self-Configuring TDMA Protocols for Enhancing Vehicle Safety With DSRC Based Vehicle-to-Vehicle Communications; Fan Yu; Subir Biswas; IEEE Journal on Selected Areas in Communications; Year: 2007, vol. 25, Issue: 8; pp. 1526-1537, DOI: 10.1109/JSAC.2007.071004.*

(Continued)

*Primary Examiner* — Cuong H Nguyen
(74) *Attorney, Agent, or Firm* — James P. Muraff; Neal, Gerber & Eisenberg LLP

(57) ABSTRACT

Apparatus and methods are disclosed for vehicle-to-vehicle cooperation to marshal traffic. An example disclosed cooperative vehicle includes an example vehicle-to-vehicle communication module and an example cooperative adaptive cruise control module. The example cooperative adaptive cruise control module determines a location of a traffic cataract. The example cooperative adaptive cruise control module also coordinates with other cooperative vehicles to form a platoon of standard vehicles. Additionally, the example cooperative adaptive cruise control module coordinates with other the cooperative vehicles to move the formed platoon through the traffic cataract at a constant speed.

20 Claims, 12 Drawing Sheets

(56) References Cited

U.S. PATENT DOCUMENTS

| | | | | |
|---|---|---|---|---|
| 2014/0195093 | A1 | 7/2014 | Litkouhi et al. | |
| 2016/0054736 | A1* | 2/2016 | Kolhouse | G08G 1/017 701/96 |
| 2017/0011633 | A1* | 1/2017 | Boegel | G05D 1/0293 |

OTHER PUBLICATIONS

DGPS-Based Vehicle-to-Vehicle Cooperative Collision Warning: Engineering Feasibility Viewpoints; Han-Shue Tan; Jihua Huang IEEE Transactions on Intelligent Transportation Systems; Year: 2006, vol. 7, Issue: 4; pp. 415-428, DOI: 10.1109/TITS.2006.883938.*

Analysis of intelligent transport system with optical vehicle-to-vehicle communication; Nikhil Sharma; Vibhor Saini; 2015 International Conference on Soft Computing Techniques and Implementations (ICSCTI); Year: 2015; pp. 155-158, DOI: 10.1109/ICSCTI.2015.7489585.*

A Road Alert Information Sharing System with Multiple Vehicles Using Vehicle-to-Vehicle Communication Considering Various Communication Network Environment; Kenta Ito; Go Hirakawa; Yoshikazu Arai; Yoshitaka Shibata; 2015 18th International Conference on Network-Based Information Systems; Year: 2015; pp. 365-370, DOI: 10.1109/NBiS.2015.56.*

Cyber Physical Systems—Oriented Design of Cooperative Control for Vehicle Platooning; Alexandru Tiganasu et al.; 2017 21st International Conference on Control Systems and Computer Science (CSCS); Year: 2017; pp. 465-470.*

Analysis of ITS-G5A V2X communications performance in autonomous cooperative driving experiments; Ignacio Parra et al., 2017 IEEE Intelligent Vehicles Symposium (IV); Year: 2017; pp. 1899-1903.*

A Survey on Platoon-Based Vehicular Cyber-Physical Systems; Dongyao Jia et al.; IEEE Communications Surveys & Tutorials; Year: 2016, vol. 18, Issue: 1; pp. 263-284.*

Core System Requirements Specification (SyRS), www.its.dot.gov/index.htm Revision A—Jun. 13, 2011 (pp. 1-131).

* cited by examiner

VEHICLE-TO-VEHICLE COOPERATION TO MARSHAL TRAFFIC

TECHNICAL FIELD

The present disclosure generally relates to vehicles with cooperative adaptive cruise control and, more specifically, vehicle-to-vehicle cooperation to marshal traffic.

BACKGROUND

Traffic congestion occurs when one or more lanes of a multilane road are blocked, for example, because of a construction or an accident. The blocked lanes reduce the flow rate of vehicles through the section of the road with the blocked lanes. The reduced flow is compounded due to the psychology of human drivers who focus on their individual travel time preferences.

SUMMARY

The appended claims define this application. The present disclosure summarizes aspects of the embodiments and should not be used to limit the claims. Other implementations are contemplated in accordance with the techniques described herein, as will be apparent to one having ordinary skill in the art upon examination of the following drawings and detailed description, and these implementations are intended to be within the scope of this application.

Example embodiments are disclosed for vehicle-to-vehicle cooperation to marshal traffic. An example disclosed cooperative vehicle includes an example vehicle-to-vehicle communication module and an example cooperative adaptive cruise control module. The example cooperative adaptive cruise control module determines a location of a traffic cataract. The example cooperative adaptive cruise control module also coordinates with other cooperative vehicles to form a platoon of standard vehicles. Additionally, the example cooperative adaptive cruise control module coordinates with the other cooperative vehicles to move the formed platoon through the traffic cataract at a constant speed.

An example method includes determining a location of a traffic cataract. The example method also includes coordinating, with a vehicle-to-vehicle communication module, with other cooperative vehicles to form a platoon of standard vehicles. Additionally, the example method includes coordinating with the other cooperative vehicles to move the formed platoon through the traffic cataract at a constant speed.

An example tangible computer readable medium comprising instructions that, when executed, cause a vehicle to determine a location of a traffic cataract. Additionally, the instructions cause the vehicle to coordinate with a vehicle-to-vehicle communication module, with other cooperative vehicles to form a platoon of standard vehicles. The example instructions also cause the vehicle to coordinate with the other cooperative vehicles to move the formed platoon through the traffic cataract at a constant speed.

BRIEF DESCRIPTION OF THE DRAWINGS

For a better understanding of the invention, reference may be made to embodiments shown in the following drawings. The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

DETAILED DESCRIPTION OF EXAMPLE EMBODIMENTS

Figure 1:
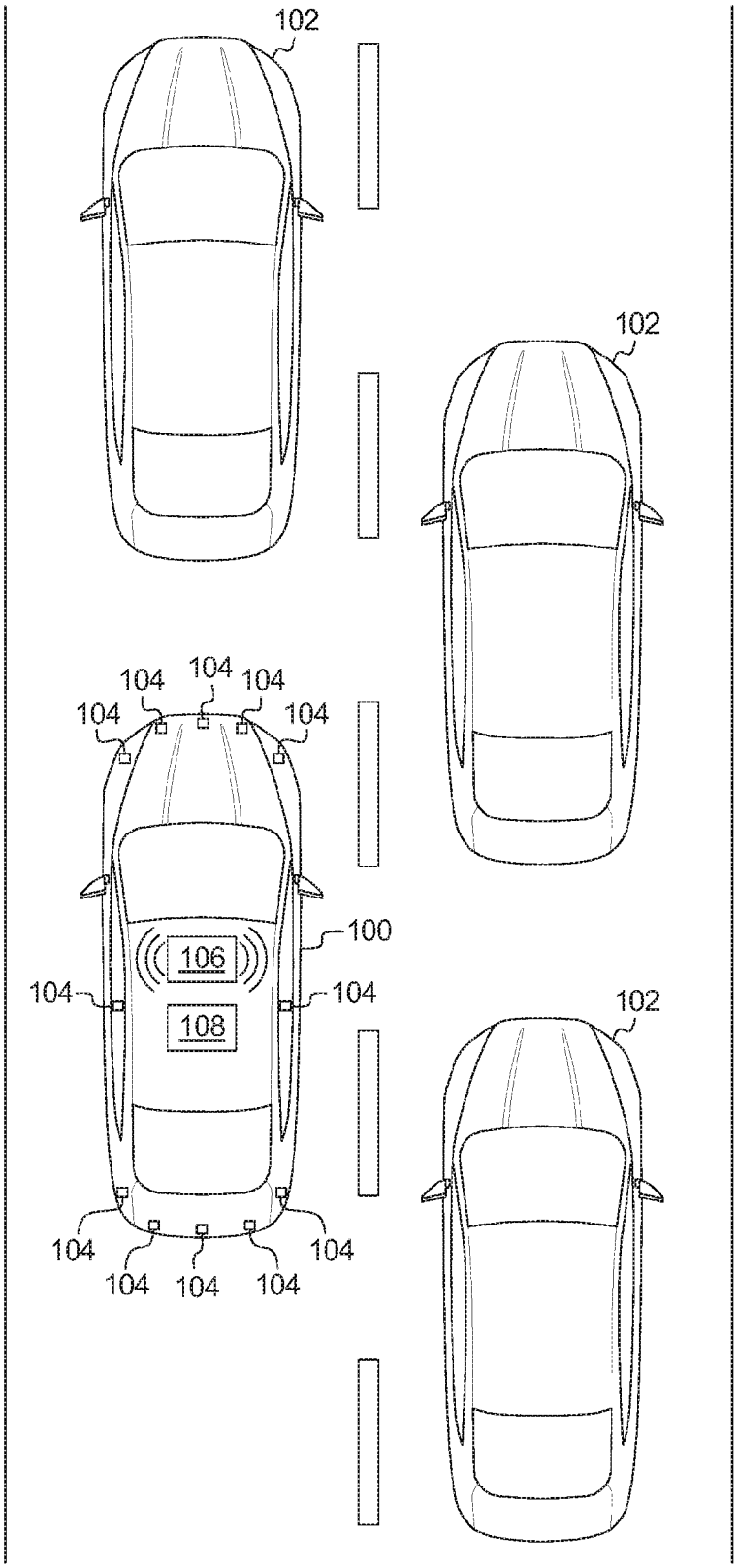
FIG. 1 illustrates a cooperative vehicle adapted to marshal traffic that operates in accordance with the teachings of this disclosure.

While the invention may be embodied in various forms, there are shown in the drawings, and will hereinafter be described, some exemplary and non-limiting embodiments, with the understanding that the present disclosure is to be considered an exemplification of the invention and is not intended to limit the invention to the specific embodiments illustrated.

Human drivers normally prefer to maximize individual travel time. However, when a traffic cataract is encountered, to benefit all the drivers on the road, priority switches from individual travel time preferences to group flow rate though the traffic cataract. As used herein, a traffic cataract refers to a section of a multilane road on which one or more lanes are blocked to cause at least one lane to merge into another lane. For example, interstate highway may have four lanes traveling in a northbound direction with two of the lands block causing the two blocked lanes to merge into the two non-blocked lanes. As another example, a four lane interstate may normally have a flow rate of 24,000 cars per hour and the traffic cataract may cause a portion of the interstate of have an ideal flow rate of 12,000 cars per hour. However, in such an example, the flow rate through the traffic cataract is reduced because of lack of coordinate on the drivers. A better group flow rate depends on moving vehicles through the traffic cataract with a coordinated headway and speed consistent with safe driving.

Human drivers tend to accelerate too fast and too late when the following distance increases and stop too fast and too late when the following distance decreases. This sets up density waves that travel upstream and prevent traffic from reaching a maximum flow rate. Before the traffic cataract, the vehicles move slowly because vehicles in closed lanes are merging into the remaining open lanes. Synchronous flow dominates in this region where vehicles are merging into the free lanes from the blocked lanes. As used herein, synchronous flow refers to (a) a continuous traffic flow with no significant stoppage and (b) synchronization of vehicle speeds across different lanes on a multilane road. As vehicles from closed lanes merge into the stream of open lanes, queued vehicles in the open lanes are pushed back. Synchronous flow may transition into a traffic jam when the density of traffic increases and the speed of the traffic flow decreases. For example, for a few miles before the traffic cataract, the traffic may transition from free flow to synchronous flow. In such an example, right before the traffic cataract, the traffic may transition from synchronous flow to a traffic jam.

Increasingly, vehicles that are equipped with vehicle-to-vehicle (V2V) communication modules that can cooperate when in transit. These vehicles include a cooperative adaptive cruise control (CACC) that coordinates, for example, acceleration and deceleration to, when in groups, efficiently use road space, prevent accidents, and warn each other about road hazards. As used herein, vehicles with CACC are referred to as "cooperative vehicles." Additionally, as used herein, vehicle without CACC are referred to as "standard vehicles." As disclosed below, the cooperative vehicles coordinate their movement to marshal cooperative vehicles and standard vehicles though the traffic cataracts. The cooperative vehicles marshal in situations where the cooperative vehicles are a relatively small percentage (e.g., greater or equal to three percent) of the vehicles round the traffic cataract.

The cooperative vehicles detect that a traffic cataract is ahead on the roadway. To detect the traffic cataracts, the cooperative (i) detects traffic transitioning into synchronous flow, (ii) receives a message from a cooperative vehicle that has passed through the traffic cataract, and/or (iii) receive a notification from a navigation system. When the cooperative vehicles pass through traffic cataract, they broadcast a message that includes the location of the traffic cataract and the direction of travel. To move through the traffic cataract, the cooperative vehicles form the standard vehicles into platoons. To form the platoons, the cooperative vehicles (i) coordinate to position themselves across all the lanes of traffic and (ii) travel at a constant speed. This forces the standard vehicles between the rows of cooperative vehicles into synchronized flow so they can't change lanes. One or more of the cooperative vehicles leads a platoon of the standard vehicles through the open lanes of the traffic cataract. The cooperative vehicles adjust the speed of the vehicles such that when the platoon reaches the traffic cataract, it travels with a speed consistent with safe driving while maintaining traffic flow. In such a manner, while individual vehicles wait to travel through the traffic cataract, the average wait for the vehicles on a whole is reduced.

Additionally, in some examples, cooperative vehicles coordinate to facilitate a Cooperatively Managed Merge and Pass (CMMP) system. The CMMP system facilitates particular drivers accessing less congested lanes. Drivers with cooperative vehicles may choose to participate in the system in which driving behavior is monitored, recorded, and evaluated in a collective manner by themselves and other participating vehicles. This system would temporarily allow for particular cooperative vehicles (sometimes referred to as "consumer vehicles") to drive at higher speeds in less-occupied lanes of traffic and also to merge and pass freely when needed. Other participating cooperative vehicles (sometimes referred to as "merchant vehicles") voluntarily occupy slower lanes of traffic to facilitated the consumer vehicle to merge into their lanes and pass as needed. The CMMP system operates with individual token-based transactions, where the merchant vehicles and the consumers' vehicles agree to trade units of cryptocurrency (sometimes referred to as "CMMP tokens"). The CMMP tokens are used to validate and authorize a transaction in which, at consumer vehicle request, the merchant vehicles either occupy slower lanes of traffic themselves, or allow the consumer vehicle to merge into their own lane and pass as necessary. The participating merchant vehicles gain CMMP tokens from the consumer vehicle. In some examples, the time allotted to the request of the consumer vehicle is based on the number of CMMP tokens chosen by the consumer vehicle to be spent at that particular time. For example, a driver of a consumer vehicle which is running late for an appointment may request to pass any participating merchant vehicles for a duration of 10 minutes on a particular road or highway for 60 CMMP tokens, at a rate of 10 seconds preferential access per token.

FIG. 1 illustrates a cooperative vehicle 100 adapted to marshal traffic that operates in accordance with the teachings of this disclosure. The illustrated example also includes standard vehicles 102. The cooperative vehicle 100 may be a standard gasoline powered vehicle, a hybrid vehicle, an electric vehicle, a fuel cell vehicle, and/or any other mobility implement type of vehicle. Additionally, the cooperative vehicle 100 includes parts related to mobility, such as a powertrain with an engine, a transmission, a suspension, a driveshaft, and/or wheels, etc. The cooperative vehicle 100 is semi-autonomous (e.g., some routine motive functions controlled by the cooperative vehicle 100) or autonomous (e.g., motive functions are controlled by the cooperative vehicle 100 without direct driver input). In the illustrated example the cooperative vehicle 100 includes range detection sensors 104, a dedicated short range communication (DSRC) module 106, and a cooperative adaptive cruise control (CACC) module 108.

The range detection sensors 104 detect ranges and speeds of vehicles 100 and 102 around the cooperative vehicle 100. The example range detection sensors 104 may include one or more cameras, ultra-sonic sensors, sonar, LiDAR, RADAR, an optical sensor, or infrared devices. The range detection sensors 104 can be arranged in and around the cooperative vehicle 100 in a suitable fashion. The range detection sensors 104 can all be the same or different. For example, the cooperative vehicle 100 may include many range detection sensors 104 (e.g., the cameras, RADAR, ultrasonic, infrared, etc.) or only a single range detection sensor 104 (e.g., LiDAR, etc.).

The example DSRC module 106 include antenna(s), radio(s) and software to broadcast messages and to establish connections between the cooperative vehicles 100, infrastructure-based modules (not shown), and mobile device-based modules (not shown). The DSRC module 106 includes a global positioning system (GPS) receiver and a inertial navigation system (INS) to share the location of the cooperative vehicle 100 and to synchronize the DSRC modules 106 of the different cooperative vehicles 100. More information on the DSRC network and how the network may communicate with vehicle hardware and software is available in the U.S. Department of Transportation's Core June 2011 System Requirements Specification (SyRS) report (available at http://www its.dot.gov/meetings/pdf/CoreSystem_SE_SyRS_RevA %20(2011-06-13).pdf), which is hereby incorporated by reference in its entirety along with all of the documents referenced on pages 11 to 14 of the SyRS report. DSRC systems may be installed on vehicles and along roadsides on infrastructure. DSRC systems incorporating infrastructure information is known as a "roadside" system. DSRC may be combined with other technologies, such as Global Position System (GPS), Visual Light Communications (VLC), Cellular Communications, and short range radar, facilitating the vehicles communicating their position, speed, heading, relative position to other objects and to exchange information with other vehicles or external computer systems. DSRC systems can be integrated with other systems such as mobile phones.

DSRC is an implementation of a vehicle-to-vehicle (V2V) or a car-to-car (C2C) protocol. Any other suitable implementation of V2V/C2C may also be used. Currently, the DSRC network is identified under the DSRC abbreviation or name. However, other names are sometimes used, usually related to a Connected Vehicle program or the like. Most of these systems are either pure DSRC or a variation of the IEEE 802.11 wireless standard. However, besides the pure DSRC system it is also meant to cover dedicated wireless communication systems between cars, which are integrated with GPS and are based on an IEEE 802.11 protocol for wireless local area networks (such as, 802.11p, etc.).

The CACC module 108 facilitates coordination, via the DSRC module 106, with other cooperative vehicles 100. As disclosed in FIGS. 2A-2E, 3A and 3B, 4, and 5, the CACC module 108 (*a*) detects the location of a traffic cataract, (b) coordinates with other cooperative vehicles 100 to arrange the vehicles 100 and 102 into platoons, and (c) coordinates the platoons moving through the traffic cataract. The CACC module 108 controls the motive functions (e.g., steering, speed, lane changing, etc.) of the cooperative vehicle 100. Additionally, in some examples, the CACC module 108 facilitates the Cooperatively Managed Merge and Pass (CMMP) system by (i) tracking CMMP tokens available to the cooperative vehicle 100, (ii) requesting preferential lane access using the CMMP tokens, and (iii) granting and facilitating the requested preferential lane access in exchange for CMMP tokens.

FIGS. 2A-2E illustrate the cooperative vehicles 100 adapted to marshal traffic to guide standard vehicles 102 through a traffic cataract 200 in the road 202. In the illustrated example of FIG. 2A, the cooperative vehicles 100 are interspersed with the standard vehicles 102. The CACC module 108 of one or more of the cooperative vehicles 100 detects the traffic cataract 200. The CACC module 108 detects the traffic cataract 200 by (a) passing through the traffic cataract 200, (b) receiving a message from another cooperative vehicle 100 or an infrastructure-based beacon that includes the location and direction of the traffic cataract 200, (c) detecting the flow of traffic transitioning to synchronous flow (see FIGS. 4 and 5 below), and/or (d) receiving a notification from a navigation system (such as Waze™, Google Maps™, Apple Maps™, etc.) via an on-board cellular modem and/or a mobile device communicatively coupled to the cooperative vehicle 100. In response to detecting the traffic cataract 200, the CACC module 108, via the DSRC module 106, broadcasts a message informing other cooperative vehicles 100 of the location and direction of the traffic cataract 200. For example, one of the cooperative vehicles 100 may not detect the traffic cataract 200 until it is moving through the traffic cataract 200. In such an example, the CACC module 108 may broadcast the message informing other cooperative vehicles 100 of the location and direction of the traffic cataract 200 even though it may not be otherwise involved in marshalling traffic through the traffic cataract 200.

Figure 2A:
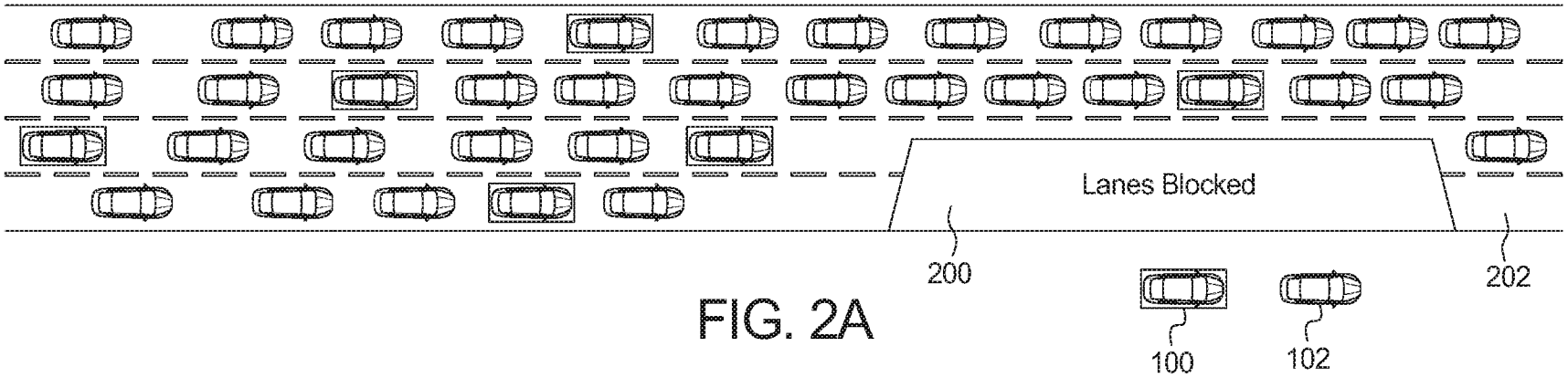
FIGS. 2A-2E illustrate cooperative vehicles adapted to marshal traffic to guide standard vehicles through a traffic cataract on the road.
Figure 2B:
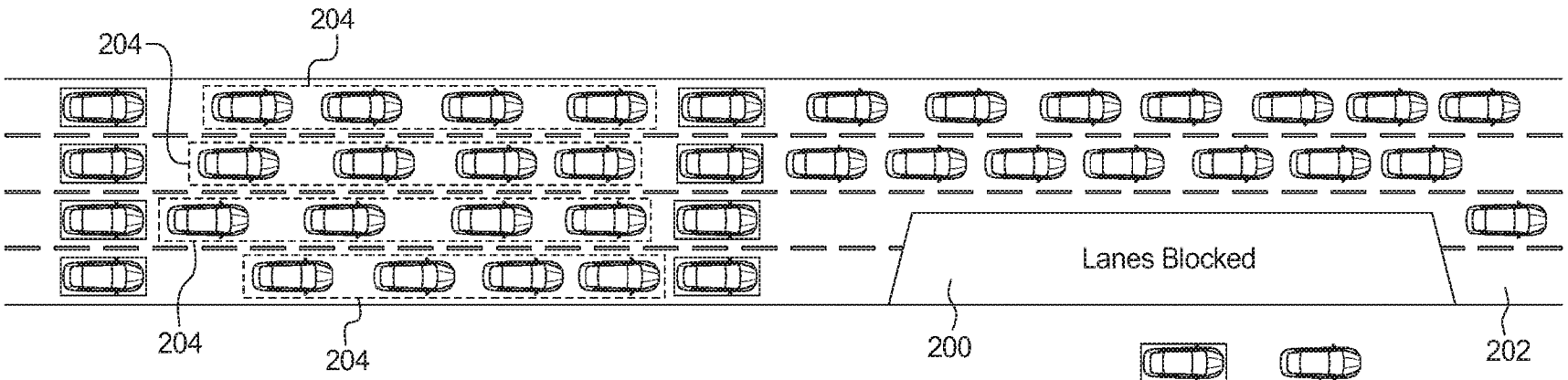

In the illustrated example of FIG. 2B, the CACC modules 108 of the cooperative vehicles 100 coordinate to form platoons 204 with the standard vehicles 102. To form the platoons 204, the CACC modules 108 determine the location, speed and headway of the corresponding cooperative vehicle 100. The headway is determined via the range detection sensors 104. The CACC modules 108 broadcast the location, speed and headway of the corresponding cooperative vehicle 100. The CACC modules 108 exchange information to determine target locations for each of the participating cooperative vehicles 100 and target speeds for the participating cooperative vehicles 100 to reach their corresponding target location at substantially the same time. The target locations (a) align across all lanes of the road 202 blocking traffic and (b) determine the platoons 204. For example, when the road 202 includes four lanes traveling in one direction, the target locations may be selected to form sets of four platoons 204 (e.g., one platoon 204 per lane per set) The target locations are selected such that the spacing and density of the standard vehicles 102 in the platoons 204 prevent the standard vehicles 102 from changing lanes. The CACC modules 108 of the participating cooperative vehicles 100 cause the cooperative vehicles 100 to move slowly at the speed of the vehicles 100 and 102 entering the traffic cataract 200. Additionally, if to get to its assigned target location, one of the participating cooperative vehicles 100 needs to change lanes, the other participating cooperative vehicles 100 will maneuver to facilitate the one of the participating cooperative vehicles 100 changing lanes.

Figure 2C:
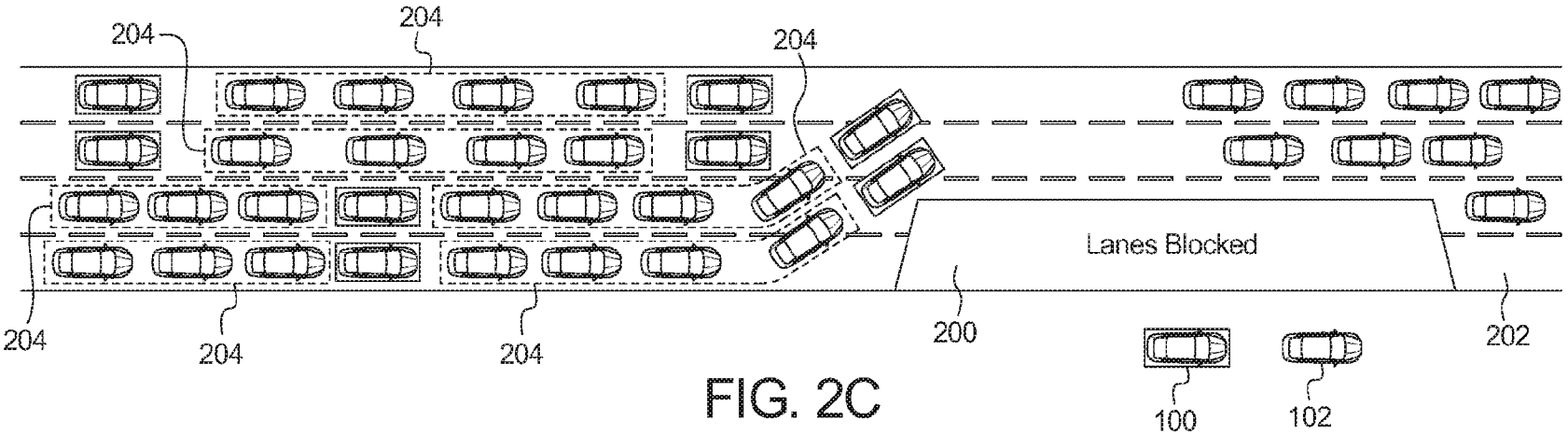

In the illustrated example of FIG. 2C, the CACC modules 108 of the cooperative vehicles 100 align across all the lanes blocking traffic and leave a short gap between the cooperative vehicles 100 leading the platoons 204 and vehicles 100 and 102 currently traversing the traffic cataract 200. The CACC modules 108 select a number of platoons 204 equal to the lanes available through the traffic cataract 200. For example, if the traffic cataract narrows the road 202 for two lanes, the CACC modules 108 may select two platoons 204 to move at a time. In some examples, the platoons 204 are selected based on wait time. In some such examples, the platoons 204 are selected are to minimize the average wait time of the vehicles 100 and 102 to be moved through the traffic cataract 200. For example, if the traffic cataract 200 narrows the road 202 from three lanes to two lanes, the CACC modules 108 may form three platoons 204 (e.g., an A platoon, a B platoon, and a C platoon). In such an example, the CACC modules 108 may coordinate to move two of the platoons 204 through the traffic cataract 200 at a time by (1) first selecting the A platoon and the B platoon, (2) second selecting the B platoon and the C platoon, and (3) thirdly selecting the C platoon and the A platoon.

Figure 2D:
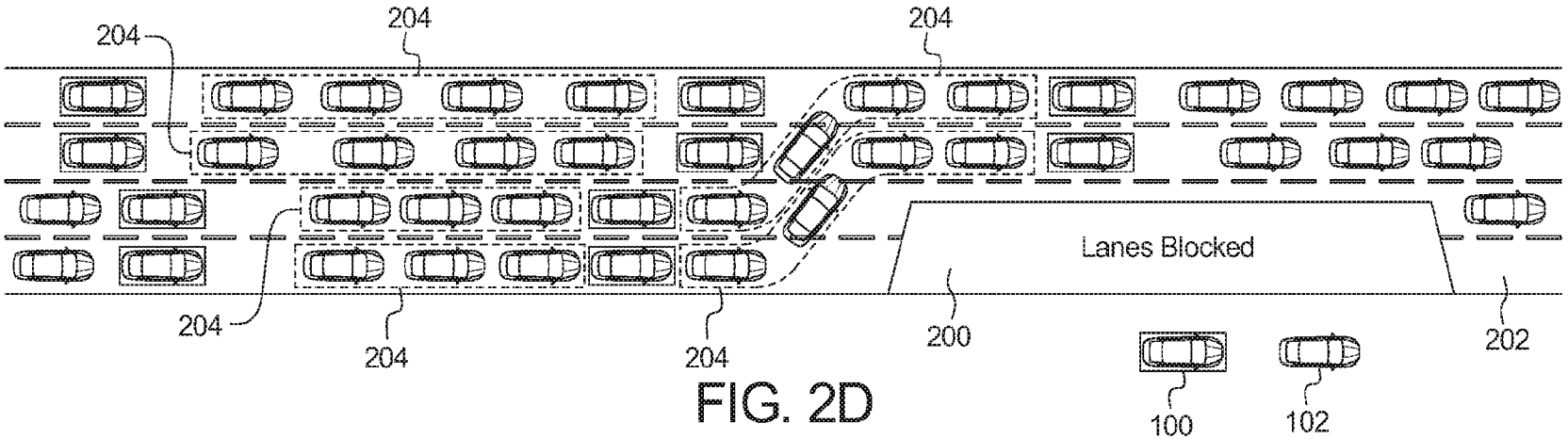
Figure 2E:
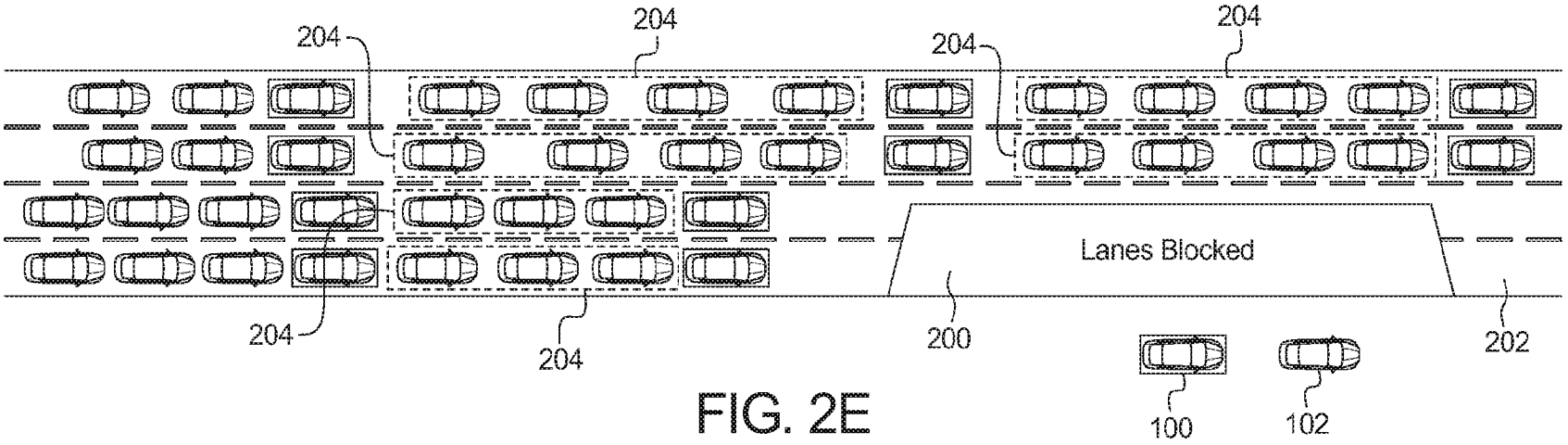

In the illustrated example of FIG. 2D, the CACC modules 108 coordinate so that the platoon(s) 204 behind the platoon(s) 204 selected to move through the traffic cataract 200 move at the same rate of speed as the departing platoon(s) 204 to fill the area left by the departing platoon(s) 204 without letting any of the standard vehicles 102 in a different platoon 204 merge into the lane. In the illustrated example of FIG. 2E, the CACC modules 108 coordinate to continue moving the platoons 204 through the traffic cataract 200. The CACC modules 108 continue to coordinate until either (a) there are not sufficient cooperative vehicles 100 to continue to marshal traffic, or (b) the traffic density becomes such that the vehicles 100 and 102 flow freely (e.g., the flow is not synchronous) through the traffic cataract 200.

Figure 3A:
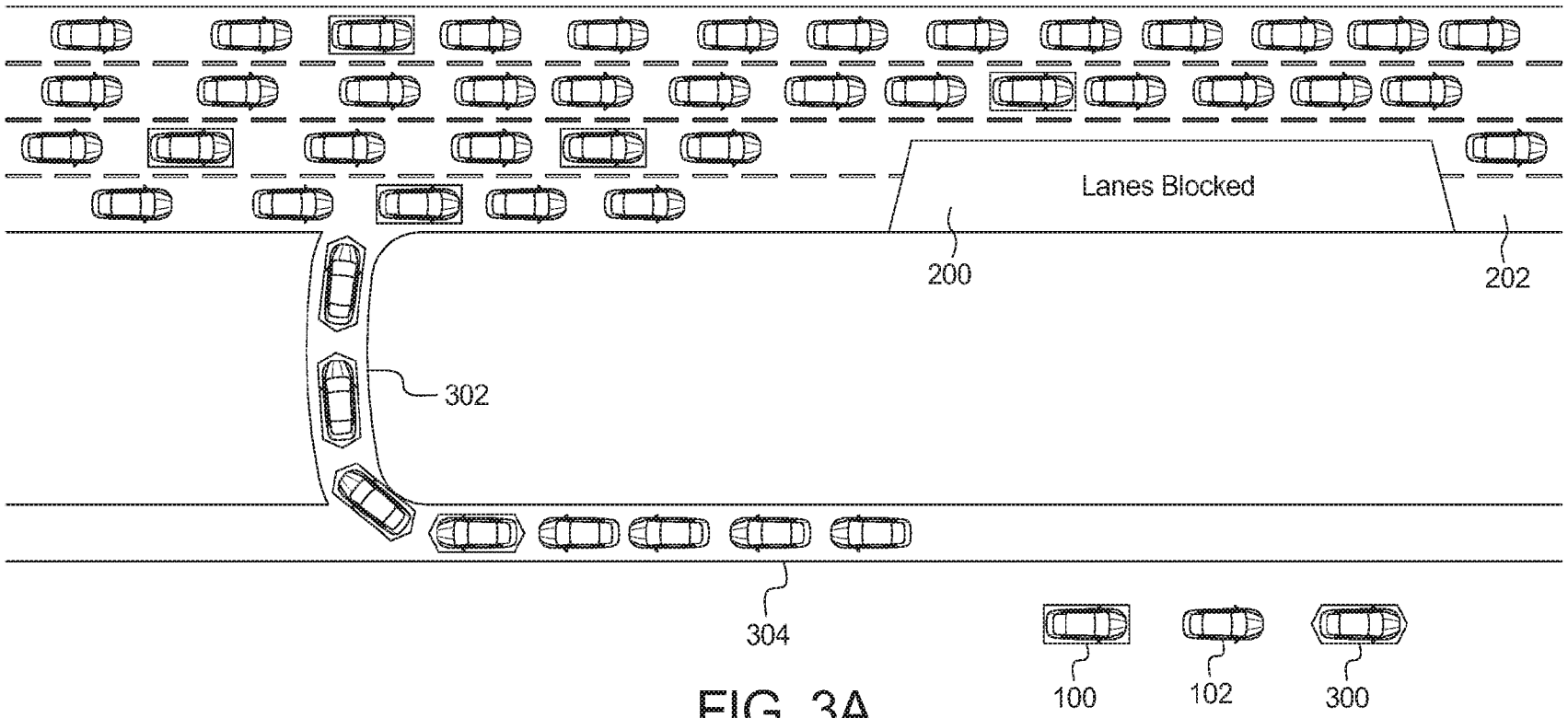
FIGS. 3A and 3B illustrated the cooperative vehicles adapted to marshal traffic to guide the standard vehicles causing spillover on an on-ramp.
Figure 3B:
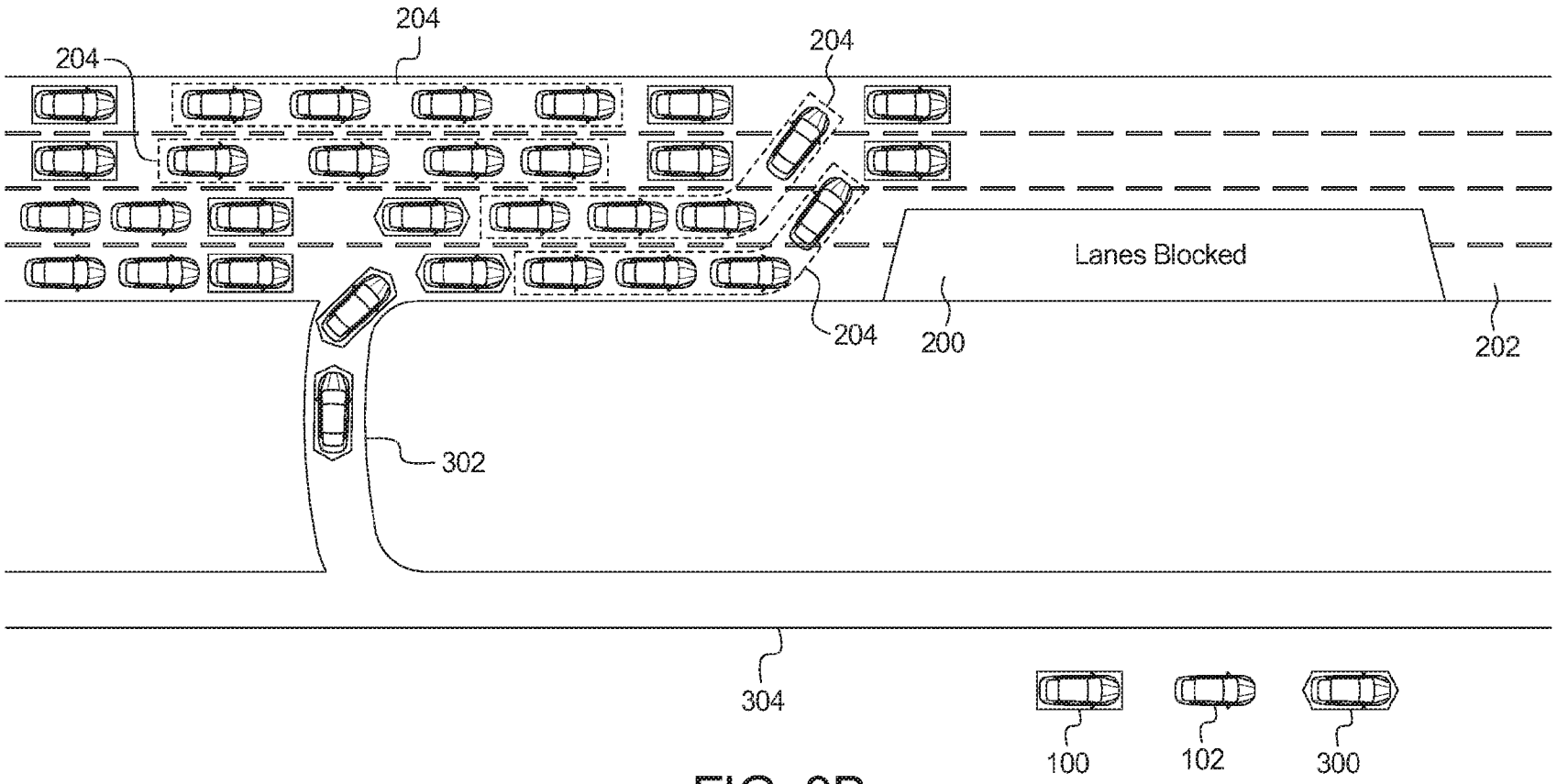

FIGS. 3A and 3B illustrate the cooperative vehicles 100 adapted to marshal traffic to guide the standard vehicles 102 causing spillback on an on-ramp 302. Spillback causes the gridlock on other roads by creating blockages of those roads as vehicles 100 and 102 attempt to enter the road 202 from the on-ramp 302. In such a manner, the traffic cataract 200 can cause traffic on side roads around the road 202. In the illustrated example of 3A, the cooperative vehicles 100 are interspersed with the standard vehicles 102. Additionally, spillover vehicles 300 waiting on the on-ramp 302 (e.g., because of the traffic cataract 200) are causing traffic on a frontage road 304. When the traffic cataract 200 is near the on-ramp 302, the CACC modules 108 coordinate the platoons 204 to take into account the spillover vehicles 300. As illustrated in example 3B, when the CACC modules 108 coordinate to move the selected platoons 204 through the traffic cataract 200, the CACC modules 108 facilitate one or more the spillover vehicles 300 to join the platoon(s) 204 moving through the traffic cataract 200. The CACC modules 108 move the participating cooperative vehicles 100 so that standard vehicles 102 in of the other platoons 204 do not merge into one of the lanes of the moving platoon 204. For example, if the two platoons 204 on the side of the road 202 with the on-ramp 302 are moving, the CACC modules 108 may coordinate so that the platoon 204 behind the moving platoon 204 in a center lane move into the lane while the platoon 204 behind the moving platoon 204 in the outside lane stops to allow the spillover vehicles 300 to enter into the lane.

Figure 4:
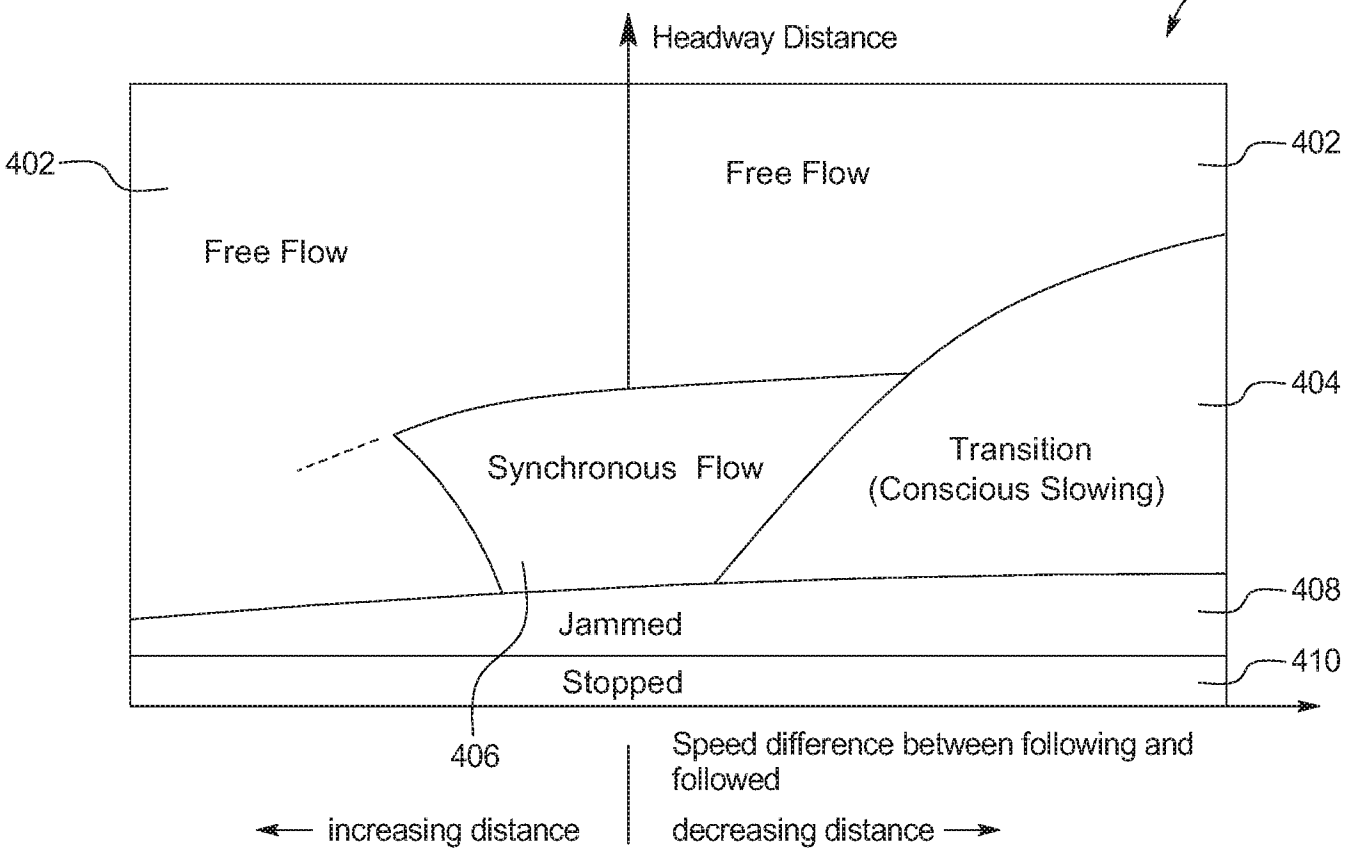
FIG. 4 is graph depicting sensors of the cooperative vehicles 100 of FIG. 1 detecting the traffic cataract in the road.

FIG. 4 is a graph 400 depicting sensors of the cooperative vehicles 100 of FIGS. 1, 2A-2E, and 3A and 3B detecting the traffic cataract 200 in the road 202. The CACC module 108 determines that the traffic cataract 200 is ahead when the CACC module 108 detects a transition from a free flow to a synchronous flow. In the illustrated example, the CACC module 108 determines (a) a headway distance (e.g. the distance between the cooperative vehicle 100 and the vehicle in front of it) and (b) an amount at which the headway distance is increasing or decreasing (sometimes referred to as the "delta headway"). The graph 400 associates the headway distance and the delta headway with the flow model of traffic (e.g., free flow, transition to synchronous flow, synchronous flow, transition to a traffic jam, and a traffic jam). In a first region 402 of the graph 400, the vehicles 100 and 102 are in a free flow. In the free flow, the vehicles 100 and 102 travel within the speed limit without significant braking (e.g., the headway distance is uncorrelated with the speed).

In a second region 404 of the graph 400, the vehicles 100 and 102 are transitioning to synchronous flow from free flow. The synchronous flow is characterized by a continuous traffic flow with no significant stoppage and synchronization of vehicle speeds across different lanes on a multilane road. In the second region, the headway distance is reduced and the vehicles 100 and 102 begin to synchronize their speeds. When the cooperative vehicle 100 is in the second region 404, the CACC module 108 determines that the traffic cataract 200 is ahead of the cooperative vehicle 100.

In a third region 406 of the graph 400, the vehicles 100 and 102 are in synchronous flow. The vehicles 100 and 102 may abruptly transition from free flow to synchronous flow. When the cooperative vehicle 100 is in the third region 406, the CACC module 108 determines that the traffic cataract 200 is ahead of the cooperative vehicle 100.

In a fourth region 408 of the graph, the vehicles 100 and 102 are jammed. Being jammed is characterized by intermittent movement (e.g., moving short distances with frequent stops). When the cooperative vehicle 100 is in the third region 406, the CACC module 108 determines that the traffic cataract 200 is likely imminent. In a fifth region 410 of the graph 400, the vehicles 100 and 102 are stopped.

Figure 5:
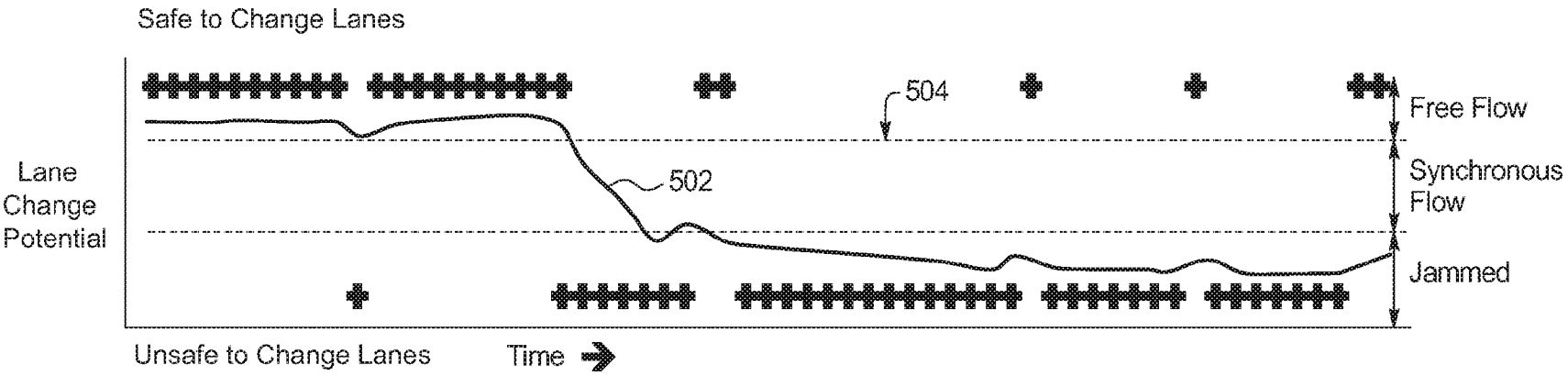
FIG. 5 is a graph depicting the range detection sensors of the cooperative vehicle of FIG. 1 detecting the traffic cataract on the road.

FIG. 5 is a graph 500 depicting the range detection sensors 104 of the cooperative vehicle 100 of FIG. 1 detecting the traffic cataract 200 on the road 202. In some examples, the CACC module 108 includes a lane change assist feature. The lane change assist determines, in conjunction with lane change sensors (e.g., cameras, ultrasonic sensors, radar, etc.), when it is safe for the cooperative vehicle 100 to switch lanes using a gap acceptance model. The gap acceptance model determines when there is an acceptable gap for the cooperative vehicle 100 to switch lanes based on the speeds of the vehicles 100 and 102 in the target lane. From time-to-time, the lane change assist determines whether it is safe to switch lanes. The graph 500 associates a rate of gap availability with the models of traffic flow (e.g., free flow, synchronous flow, jammed, etc.). The graph 500 shows when the lane change assist determines it is safe and unsafe to switch lanes. Additionally, the graph 500 depicts a traffic flow rate line 502. When it is safe to switch lanes, the traffic flow rate line 502 increases. Conversely, then it is unsafe to switch lanes, the traffic flow rate line 502 decreases. When the traffic flow rate line 502 is below a threshold 504 for a period of time (e.g., thirty seconds, one minute, etc.), the CACC module 108 determines that the vehicles 100 and 102 are in a synchronous flow.

Figure 6:
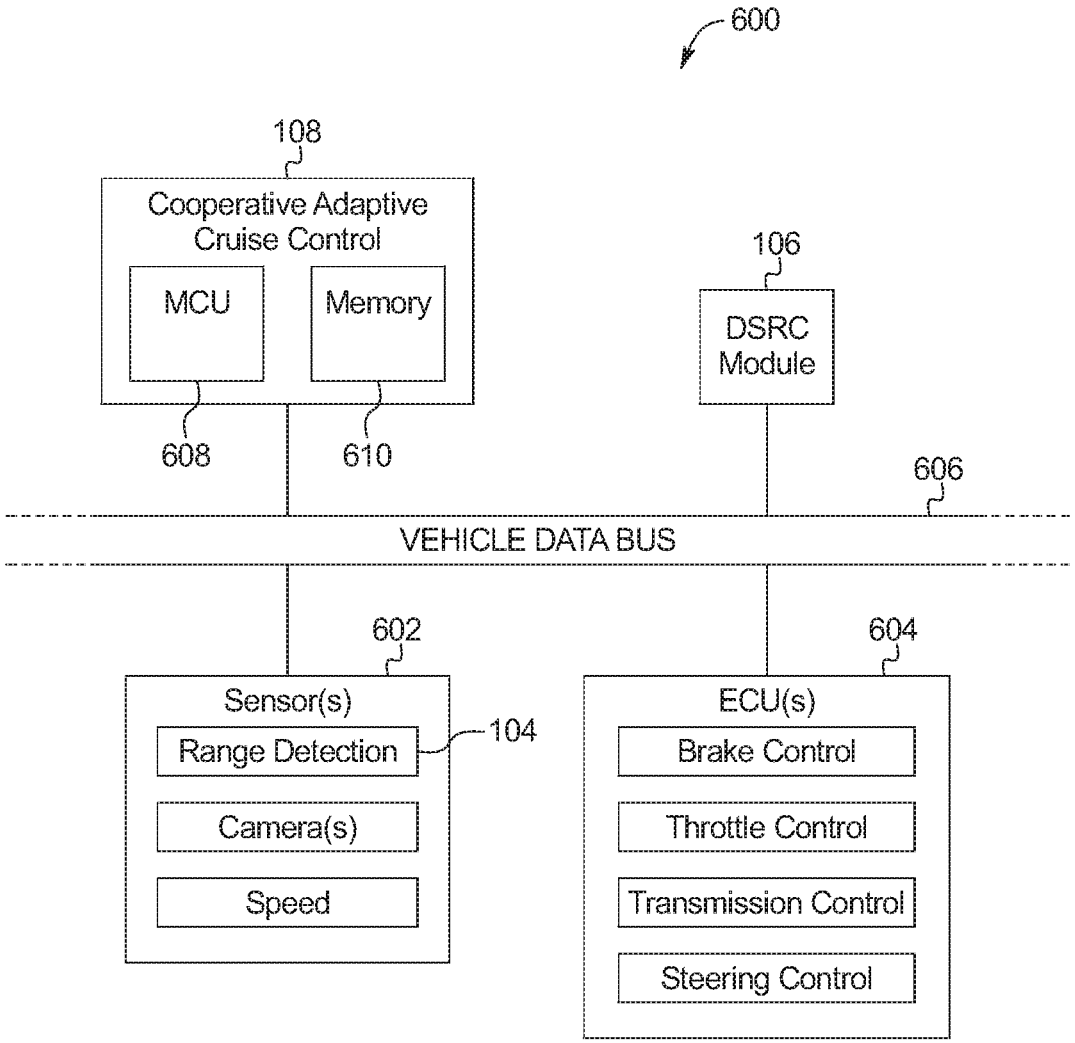
FIG. 6 is a block diagram of electronic components of the cooperative vehicle of FIG. 1.

FIG. 6 is a block diagram of electronic components 600 of the cooperative vehicle 100 of FIG. 1. In the illustrated example, the electronic components 600 include the DSRC module 106, the CACC module 108, sensors 602, electronic control units (ECUs) 604, and a vehicle data bus 606.

The CACC module 108 includes a processor or controller 608 and memory 610. The processor or controller 608 may be any suitable processing device or set of processing devices such as, but not limited to: a microprocessor, a microcontroller-based platform, a suitable integrated circuit, one or more field programmable gate arrays (FPGAs), and/or one or more application-specific integrated circuits (ASICs). The memory 610 may be volatile memory (e.g., RAM, which can include non-volatile RAM, magnetic RAM, ferroelectric RAM, and any other suitable forms); non-volatile memory (e.g., disk memory, FLASH memory, EPROMs, EEPROMs, memristor-based non-volatile solid-state memory, etc.), unalterable memory (e.g., EPROMs), read-only memory, and/or high-capacity storage devices (e.g., hard drives, solid state drives, etc). In some examples, the memory 610 includes multiple kinds of memory, particularly volatile memory and non-volatile memory.

The memory 610 is computer readable media on which one or more sets of instructions, such as the software for operating the methods of the present disclosure can be embedded. The instructions may embody one or more of the methods or logic as described herein. In a particular embodiment, the instructions may reside completely, or at least partially, within any one or more of the memory 610, the computer readable medium, and/or within the processor 608 during execution of the instructions.

The terms "non-transitory computer-readable medium" and "computer-readable medium" should be understood to include a single medium or multiple media, such as a centralized or distributed database, and/or associated caches and servers that store one or more sets of instructions. The terms "non-transitory computer-readable medium" and "computer-readable medium" also include any tangible medium that is capable of storing, encoding or carrying a set of instructions for execution by a processor or that cause a system to perform any one or more of the methods or operations disclosed herein. As used herein, the term "computer readable medium" is expressly defined to include any type of computer readable storage device and/or storage disk and to exclude propagating signals.

The sensors 602 may be arranged in and around the cooperative vehicle 100 in any suitable fashion. The sensors 602 may be mounted to measure properties around the exterior of the cooperative vehicle 100. Additionally, some sensors 602 may be mounted inside the cabin of the cooperative vehicle 100 or in the body of the cooperative vehicle 100 (such as, the engine compartment, the wheel wells, etc.) to measure properties in the interior of the cooperative vehicle 100. For example, such sensors 602 may include accelerometers, odometers, tachometers, pitch and yaw sensors, microphones, tire pressure sensors, and biometric sensors, etc. In the illustrated example, the sensors 602 include the range detection sensors 104. The sensors 602 may also include, for example, cameras and/or speed sensors (e.g., wheel speed sensors, drive shaft sensors, etc.).

The ECUs 604 monitor and control the subsystems of the cooperative vehicle 100. The ECUs 604 communicate and exchange information via a vehicle data bus (e.g., the vehicle data bus 606). Additionally, the ECUs 604 may communicate properties (such as, status of the ECU 604, sensor readings, control state, error and diagnostic codes, etc.) to and/or receive requests from other ECUs 604. Some cooperative vehicle 100 may have seventy or more ECUs 604 located in various locations around the cooperative vehicle 100 communicatively coupled by the vehicle data bus 606. The ECUs 604 are discrete sets of electronics that include their own circuit(s) (such as integrated circuits, microprocessors, memory, storage, etc.) and firmware, sensors, actuators, and/or mounting hardware. In the illustrated example, the ECUs 604 include parts that facilitate the CACC module 108 controlling the motive functions of the cooperative vehicle 100, such as a brake control unit, a throttle control unit, a transmission control unit, and a steering control unit.

The vehicle data bus 606 communicatively couples the DSRC module 106, the CACC module 108, sensors 602, and the ECUs 604. In some examples, the vehicle data bus 606 includes one or more data buses. The vehicle data bus 606 may be implemented in accordance with a controller area network (CAN) bus protocol as defined by International Standards Organization (ISO) 11898-1, a Media Oriented Systems Transport (MOST) bus protocol, a CAN flexible data (CAN-FD) bus protocol (ISO 11898-7) and/a K-line bus protocol (ISO 9141 and ISO 14230-1), and/or an Ethernet™ bus protocol IEEE 802.3 (2002 onwards), etc.

Figure 7:
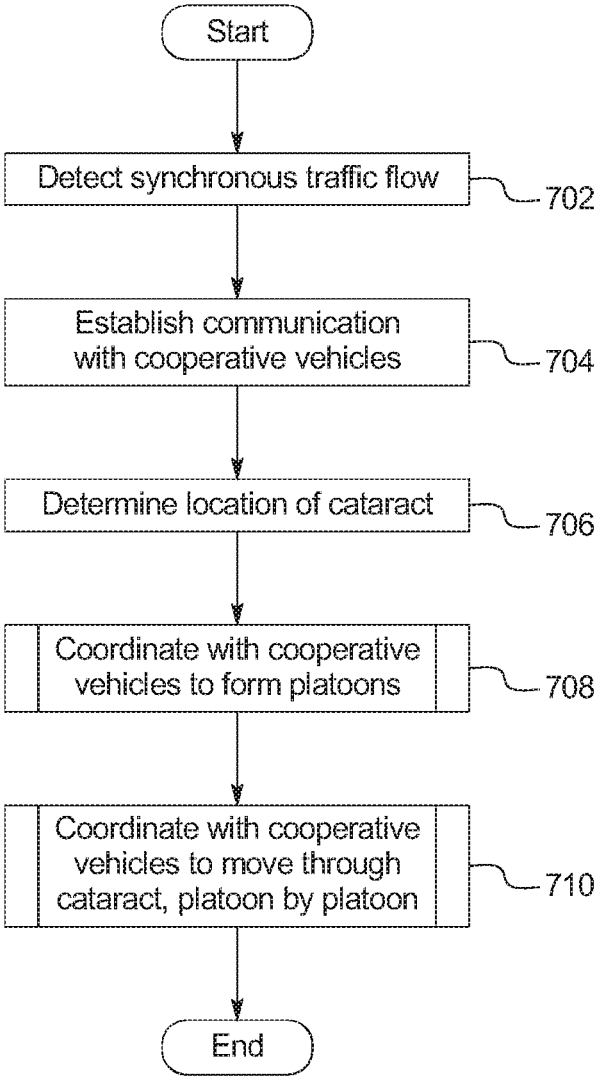
FIG. 7 is a flowchart of a method to facilitate marshalling traffic through a cataract in the road.

FIG. 7 is a flowchart of a method to facilitate marshalling traffic through a traffic cataract 200 in the road 202. Initially at block 702, the CACC module 108 of one or more of the cooperative vehicles 100 detects synchronous traffic flow. In some examples, the CACC module 108 detects synchronous traffic flow as outlines in the graphs 400 and 500 of FIGS. 4 and 5 above. At block 704, the CACC module 108 establishes communication with the other cooperative vehicles 100 via the DSRC module 106. At block 706, the CACC module 108 determines the location of the traffic cataract 200. In some examples, the CACC module 108 receives the location from a message from a cooperative vehicle 100 that has passed through the traffic cataract 200, and/or a notification from a navigation system. Alternatively, or additionally, in some examples, the CACC module 108 estimates the location based on detecting the transition to the synchronous flow. At block 708, the CACC module 108 coordinates with other cooperative vehicles 100 to form platoons 204 with the standard vehicles 102. An example method for coordinating with other cooperative vehicles 100 to form platoons 204 with the standard vehicles 102 is disclosed in association with FIG. 8 below. At block 710, the CACC module 108 coordinates with other cooperative vehicles 100 to move the platoons 204 through the traffic cataract 200. An example method for coordinating with other cooperative vehicles 100 to move the platoons 204 through the traffic cataract 200 is disclosed in association with FIG. 8 below.

Figure 8:
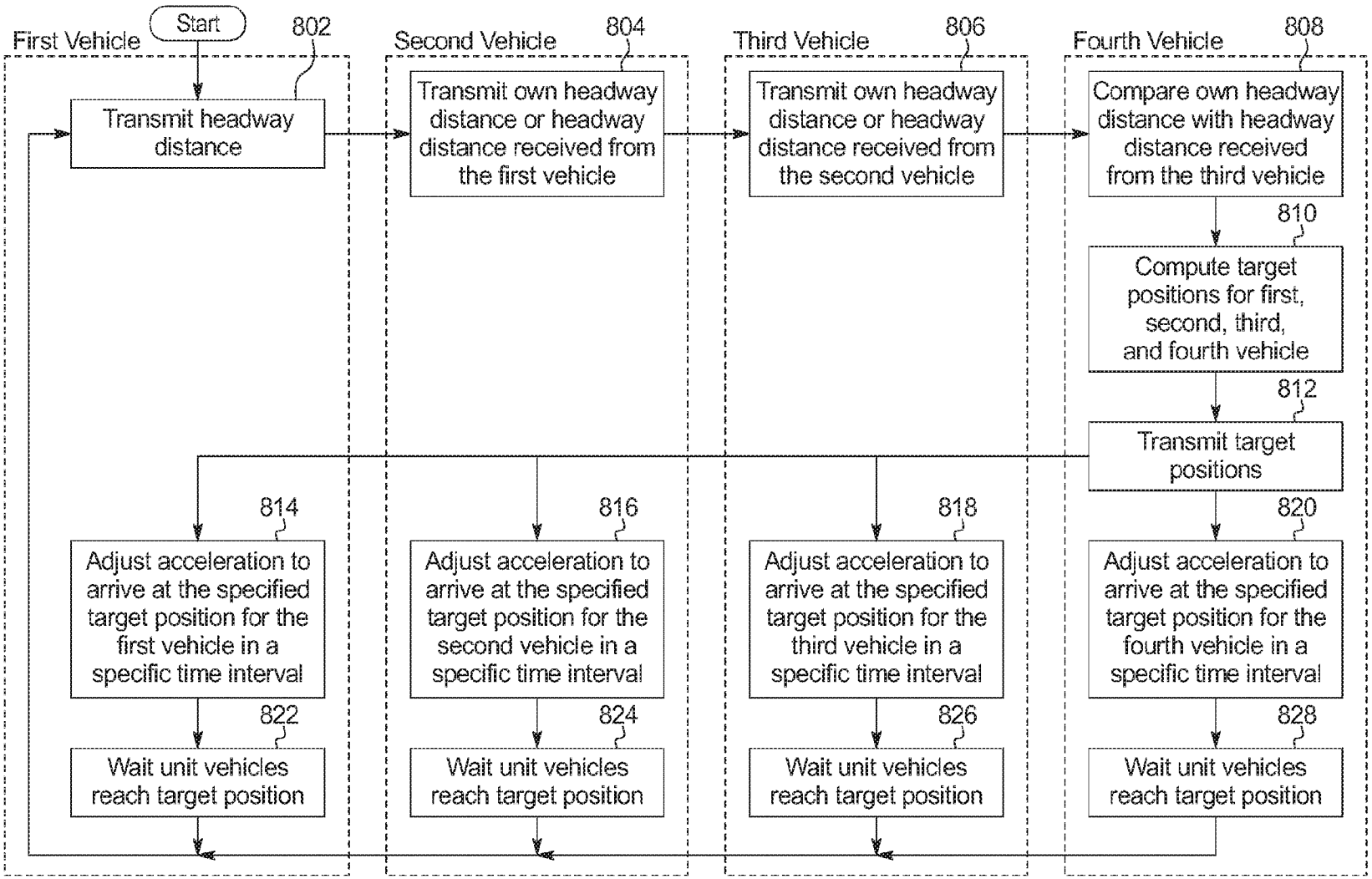
FIG. 8 is a flowchart of a method for the cooperative vehicles of FIG. 1 to cooperate to marshal traffic through the traffic cataract.

FIG. 8 is a flowchart of a method for the cooperative vehicles 100 of FIG. 1 to cooperate to marshal traffic through the traffic cataract 200. In the illustrated example, the method includes four cooperative vehicles 100*a*-100*d*. Any number of cooperative vehicles 100 may be used. Initially, at block 802, a first cooperative vehicle 100*a* transmits its location and headway distance. At block 804, a second cooperative vehicle 100*b* transmits (a) the greater of its own headway distance or the headway distance received from the first cooperative vehicle 100*a*, and (b) its location and the location received from the first cooperative vehicle 100*a*. At block 806, a third cooperative vehicle 100*c* transmits (a) the greater of its own headway distance or the headway distance received from the second cooperative vehicle 100*b*, and (b) its location and the locations received from the second cooperative vehicle 100*b*. At block 808, a fourth cooperative vehicle 100*d* compares its own headway distance with the headway distance received from the third cooperative vehicle 100*c*. At block 810, the fourth cooperative vehicle 100*d* determines target positions for the cooperative vehicles 100*a*-100*d* based on the (a) the greater of the headways compared at block 808, and (b) the locations of the cooperative vehicles 100*a*-100*d*. At block 812, the fourth cooperative vehicle 100*d* transmits (a) the target positions determined at block 810 and (b) a time interval at which the cooperative vehicles 100*a*-100*d* are to be at the target positions. The method continues at blocks 814, 816, 818, and 820.

At block 814, the first cooperative vehicle 100*a* adjusts (e.g., increases or decreases) its acceleration to arrive at the specified target position for the first cooperative vehicle 100*a* at the specific time interval. At block 816, the second cooperative vehicle 100*b* adjusts (e.g., increases or decreases) its acceleration to arrive at the specified target position for the second cooperative vehicle 100*b* at the specific time interval. At block 818, the third cooperative vehicle 100*c* adjusts (e.g., increases or decreases) its acceleration to arrive at the specified target position for the third cooperative vehicle 100*c* at the specific time interval. At block 820, the fourth cooperative vehicle 100*d* adjusts (e.g., increases or decreases) its acceleration to arrive at the specified target position for the fourth cooperative vehicle 100*d* at a specific time interval. At blocks 822, 824, 826, and 828, the cooperative vehicles 100*a*-100*d* wait until the other cooperative vehicles 100*a*-100*d* are at their respective target position.

Figure 9:
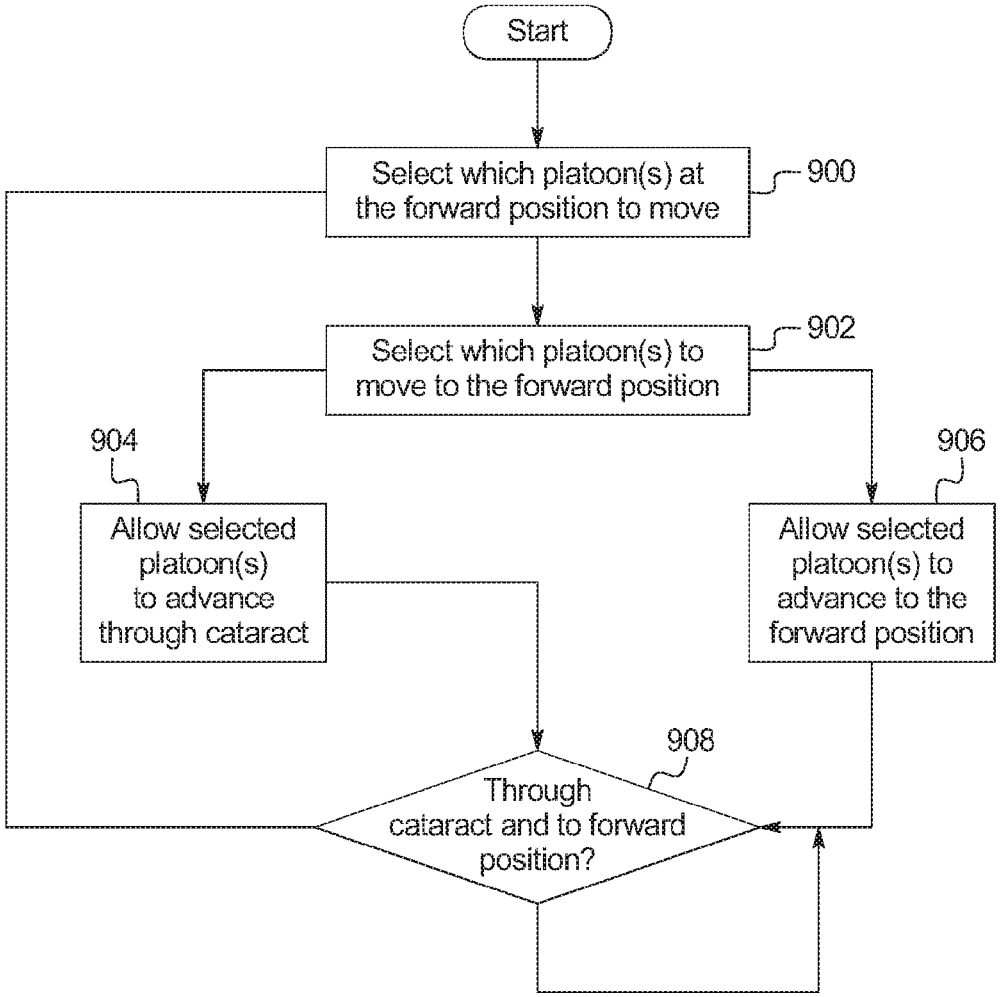
FIG. 9 is a flowchart of a method for the cooperative vehicles of FIG. 1 to cooperate to move a platoon through the traffic cataract.

FIG. 9 is a flowchart of a method for the cooperative vehicles 100 of FIG. 1 to cooperate to move a platoon 204 through the traffic cataract 200. Initially, at block 902, the CACC modules 108 of the participating cooperative vehicles 100 select the participating cooperative vehicles 100 that are at the position(s) closest to the traffic cataract 200. At block 904, the CACC modules 108 of the participating cooperative vehicles 100 select which platoon(s) 204 at the position(s) closest to the traffic cataract 200 is/are to move through the cataract. The number of platoons 204 to move is based on the number of open lanes through the traffic cataract 200. Which one(s) of the platoon(s) 204 at the position(s) closest to the traffic cataract 200 to move is selected based on, for example, reducing the average wait time of the vehicles 100 and 102 that are to proceed through the traffic cataract 200. The method continues at blocks 906 and 908.

At block 906, the CACC modules 108 coordinate to allow the platoon(s) 204 selected at block 904 to advance through the traffic cataract 200, led by corresponding one(s) of the participating cooperative vehicles 100. The lead participating cooperative vehicle(s) 100 adjust the speed of the platoon(s) 204 so that the platoon(s) 204 traverse the traffic cataract 200 at a constant speed. At block 908, the CACC modules 108 coordinate to allow the platoon(s) 204 that are behind the platoon(s) 204 moving at block 906 to move to fill the lane vacated by the moving platoon(s) 204. The lead participating cooperative vehicle(s) 100 adjust the speed of the platoon(s) 204 so that the platoon(s) 204 move into the vacated portion of the lane(s) without standard vehicles 102 from other platoons 204 able to switch to the vacated claims. At block 910, the CACC modules 108 wait until the platoon(s) 204 moving through the traffic cataract 200 and the platoon(s) 204 moving into the vacated lane are in position to facilitate more platoon(s) 204 traversing the traffic cataract 200. The method then returns to block 902.

The flowcharts of FIGS. 7, 8 and 9 are representative of machine readable instructions stored in memory (such as the memory 610 of FIG. 6) that comprise one or more programs that, when executed by a processor (such as the processor 608 of FIG. 6), cause the cooperating vehicle 100 to implement the example CACC module 108 of FIGS. 1 and 6. Further, although the example program(s) is/are described with reference to the flowcharts illustrated in FIG. FIGS. 7, 8 and 9, many other methods of implementing the example CACC module 108 may alternatively be used. For example, the order of execution of the blocks may be changed, and/or some of the blocks described may be changed, eliminated, or combined.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects. Further, the conjunction "or" may be used to convey features that are simultaneously present instead of mutually exclusive alternatives. In other words, the conjunction "or" should be understood to include "and/or". The terms "includes," "including," and "include" are inclusive and have the same scope as "comprises," "comprising," and "comprise" respectively.

The above-described embodiments, and particularly any "preferred" embodiments, are possible examples of implementations and merely set forth for a clear understanding of the principles of the invention. Many variations and modifications may be made to the above-described embodiment (s) without substantially departing from the spirit and principles of the techniques described herein. All modifications are intended to be included herein within the scope of this disclosure and protected by the following claims.

What is claimed is:

1. A cooperative vehicle comprising:

a vehicle-to-vehicle communication module; and an cooperative adaptive cruise control module to:

determine a location of a traffic cataract;

coordinate with other cooperative vehicles to form a platoon of standard vehicles; and coordinate with the other cooperative vehicles to move the formed platoon through the traffic cataract at a constant speed.

2. The cooperative vehicle of claim 1, wherein the standard vehicles are not equipped with a vehicle-to-vehicle communication module.

3. The cooperative vehicle of claim 1, wherein the cooperative adaptive cruise control module is to detect an existence of the traffic cataract.

4. The cooperative vehicle of claim 3, wherein to detect the existence of the traffic cataract, the cooperative adaptive cruise control module is to detect traffic transitioning from a free flow state to a synchronous flow state.

5. The cooperative vehicle of claim 4, wherein to detect the traffic transitioning from the free flow state to the synchronous flow state, the cooperative adaptive cruise control module is to monitor headway and change in the headway.

6. The cooperative vehicle of claim 4, wherein to detect the traffic transitioning from the free flow state to the synchronous flow state, the cooperative adaptive cruise control module is to monitor a rate of gap availability.

7. The cooperative vehicle of claim 1, wherein to coordinate with the other cooperative vehicles to form the platoon of the standard vehicles, the cooperative adaptive cruise control module is to, in conjunction with the other cooperative vehicles, determine a target location and a target time period for the cooperative vehicle.

8. The cooperative vehicle of claim 7, wherein the cooperative adaptive cruise control module is to adjust a speed of the cooperative vehicle to reach the target location at the target time period.

9. The cooperative vehicle of claim 1, wherein to determine the location of the traffic cataract, the cooperative adaptive cruise control module is to receive, via the vehicle-to-vehicle communication module, a message from another cooperative vehicle that has traversed the traffic cataract, the message including the location of the traffic cataract.

10. A method of controlling a cooperative vehicle comprising:

determining, with a processor, a location of a traffic cataract;

coordinating, with a vehicle-to-vehicle communication module, with other cooperative vehicles to form a platoon of standard vehicles; and coordinating with the other cooperative vehicles to move the formed platoon through the traffic cataract at a constant speed.

11. The method of claim 10, wherein the standard vehicles are not equipped with a vehicle-to-vehicle communication module.

12. The method of claim 10, including detecting an existence of the traffic cataract.

13. The method of claim 12, wherein detecting the existence of the traffic cataract includes detecting traffic transitioning from a free flow state to a synchronous flow state.

14. The method of claim 13, wherein detecting the traffic transitioning from the free flow state to the synchronous flow state includes monitoring headway and change in the headway.

15. The method of claim 13, wherein detecting the traffic transitioning from the free flow state to the synchronous flow state includes monitoring a rate of gap availability.

16. The method of claim 10, wherein coordinating with the other cooperative vehicles to form the platoon of the standard vehicles includes, in conjunction with the other cooperative vehicles, determining a target location and a target time period for the cooperative vehicle.

17. The method of claim 16, including adjusting a speed of the cooperative vehicle to reach the target location at the target time period.

18. The method of claim 10, wherein determining the location of the traffic cataract, includes receiving, via the vehicle-to-vehicle communication module, a message from another cooperative vehicle that has traversed the traffic cataract, the message including the location of the traffic cataract.

19. A tangible computer readable medium comprising instructions that, when executed, cause a cooperative vehicle to:

determine, via a vehicle-to-vehicle communication module, a location of a traffic cataract based on a message from a second cooperative vehicle proximate to the traffic cataract;

coordinate, via the vehicle-to-vehicle communication module, with a plurality of third cooperative vehicles to form a platoon of standard vehicles; and coordinate, via the vehicle-to-vehicle communication module, with the plurality of third cooperative vehicles to move the formed platoon through the traffic cataract at a constant speed, wherein no coordination messages are communicated to the standard vehicles.

20. The cooperative vehicle of claim 1, wherein the to coordinate with other cooperative vehicles to form a platoon of standard vehicles, the cooperative adaptive cruise control module is to move the cooperative vehicle, in coordination with the other cooperative vehicles, to form two rows across all lanes of traffic in a travel direction so that the standard vehicles are between two rows.

* * * * *